United States Patent [19]

Pilgrim et al.

[11] Patent Number: 5,050,330

[45] Date of Patent: Sep. 24, 1991

[54] GUN REST

[75] Inventors: Johnny C. Pilgrim; Johnny D. Franks, both of Kingwood, Tex.

[73] Assignee: Pilgrim Archery Products, Inc., Kingwood, Tex.

[21] Appl. No.: 524,519

[22] Filed: May 17, 1990

[51] Int. Cl.[5] ..... F41A 23/00

[52] U.S. Cl. ..... 42/94; 211/64; 248/174

[58] Field of Search ..... 42/94; 211/64, 70.1; 89/37.04, 40.04; 73/167; 248/152, 174

[56] References Cited

U.S. PATENT DOCUMENTS

| | | | |
|---|---|---|---|
| 2,569,435 | 9/1951 | Martin | 42/94 |
| 2,740,530 | 4/1956 | Ponder | 42/94 |
| 3,746,177 | 7/1973 | Vilotti | 211/64 |
| 3,913,746 | 10/1975 | Burton | 42/94 |
| 3,935,657 | 2/1975 | Wade | 42/94 |
| 4,449,314 | 5/1984 | Sorensen | 42/94 |
| 4,588,531 | 12/1985 | Kilby | 42/94 |
| 4,807,381 | 2/1989 | Southard | 42/94 |

OTHER PUBLICATIONS

*Shooting Times*, "Hornady Gun Rest", Jan. 1, 1988, p. 32.

*Shooting Times*, "Roosevelt Accurest", Feb. 1989, p. 74.

*Primary Examiner*—Michael J. Carone

*Attorney, Agent, or Firm*—Sughrue, Mion, Zinn, Macpeak & Seas

[57] ABSTRACT

A gun rest is formed from a sheet of resilient plastic foam material which is adapted to be vertically disposed on one edge thereof with the upper edge having a plurality of grooves formed therein of varying depth for receiving and snugly holding the forearm of a rifle therein. A vertically extending slit is formed in the bottom surface of the sheet which is adapted to fit over the top edge of a motor vehicle window glass and blind slits are formed in a front face of the sheet into which individual ammunition cartridges may be pressed and securely held.

4 Claims, 1 Drawing Sheet

GUN REST

BACKGROUND OF THE INVENTION

The present invention is directed to a gun rest and more specifically to a gun rest having a plurality of gun placement grooves at different heights and which may be mounted on either a flat surface or on a vehicle window.

One form of well known rifle rest is comprised of a plurality of bags of different sizes which may be filled with sand or the like and provided with a recessed upper surface for supporting the rifle forearm. Such rifle rest bags however, are cumbersome to transport and store in the filled condition and are susceptible to leakage. To empty the bags after each use and refill the bags before the next use is a time consuming and cumbersome operation, making it necessary to additionally carry a container of suitable filler material in the event suitable filler material is not available at the site.

The rest bags are frequently used with an adjustable bench rest comprised of a plate adjustably mounted on a suitable tripod for vertical adjustment. The forearm of the rifle can also be mounted directly on the adjustable height bench rest. However, such a bench rest is generally only usable with a rigid bench and must be properly leveled and height adjusted before each use.

Another type of gun rest is comprised of a triangular shaped molded plastic member having three different shooting levels along each edge to provide a total of nine different shooting edges. However, each shooting level upon which the forearm of the rifle is adapted to rest, is completely flat, so that the forearm is not firmly gripped and held in position against lateral movement.

SUMMARY OF THE INVENTION

The present invention provides a new and improved gun rest comprised of a sheet of polyethylene material having a plurality of substantially U-shaped grooves formed in one edge thereof in a step-like manner for selectively receiving and snugly holding the forearm of a rifle and which is usable for accommodating forearms of various widths.

The present invention provides a new and improved gun rest having a base of suitable width to provide proper stability for the gun rest on different surfaces and an upwardly angled transverse slit extending into the gun rest to enable the gun rest to be supported on the upper edge of a partially raised vehicle window.

The present invention provides a new and improved gun rest having an ammunition storage arrangement comprised of a plurality of blind openings extending into a vertical surface of the gun rest on a side thereof facing the shooter, each of which is adapted to receive a single cartridge.

The foregoing and other objects, features and advantages of the invention will be apparent from the following more particular description of a preferred embodiment of the invention as illustrated in the accompanying drawings.

DETAILED DESCRIPTION OF THE INVENTION

Figure 2:
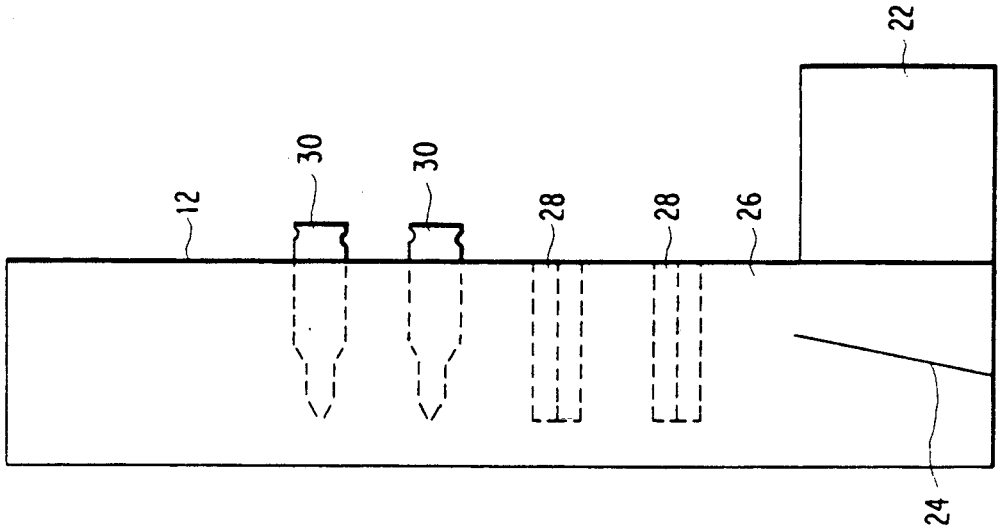
FIG. 2 is a side elevational view thereof.

The gun rest 10 is comprised of a sheet of foam plastic material 12 having three gun placement grooves, 14, 16 and 18 cut into the upper edge thereof at varying depths to allow the shooter to choose the correct height for supporting the gun for each shot required. The sheet of foam plastic material, prior to cutting the grooves, is approximately 8 inches high, 10 inches wide and 2 inches thick. The grooves are formed by a die cutting operation. The plastic material is preferably a low density polyethylene foam. The density may vary from 1.5 pounds per cubic foot to 9 pounds per cubic foot with the preferable density being approximately 2 pounds per cubic foot. While the individual grooves 14, 16 and 18 can be dimensioned to support a specific gun, a substantially universal gun rest can be provided by providing the bottom of each groove with approximately a 2 inch diameter rounded cut. The upwardly extending projections defining the grooves are approximately 1 inch wide and have rounded top edges. The bottom of each groove 14, 16 and 18 may be spaced from the bottom edge 20 of the sheet of foam plastic material at distances of 7 inches, 5 inches and 3 inches, respectively.

In order to provide stability for the gun rest, a strip 22 of identical foam material, approximately 2"×2"×10" is secured along the bottom edge of the sheet 12 by heat lamination, an adhesive or any other suitable means. In order to support the gun rest 10 on the upper edge of a motor vehicle window which is in the partly raised condition, an upwardly angled cut 24 is made in the bottom of the sheet 12. The cut is approximately 2 inches deep and extends the entire width of the sheet 12 and is disposed at an angle of approximately 7° with respect to the vertical since most motor vehicle door windows are not disposed absolutely vertically.

The gun rest 10 also provides ammunition storage by providing a plurality of cross cuts into the front surface 26 of the sheet 12 which do not extend all the way through the sheet. Due to the low density nature of the foam plastic material, a cartridge 30 may be pushed into each of the cross-shaped slits 28 and be frictionally held therein. Thus, the ammunition will be conveniently located at the shooter's fingertips in a safe, secure manner.

Figure 1:
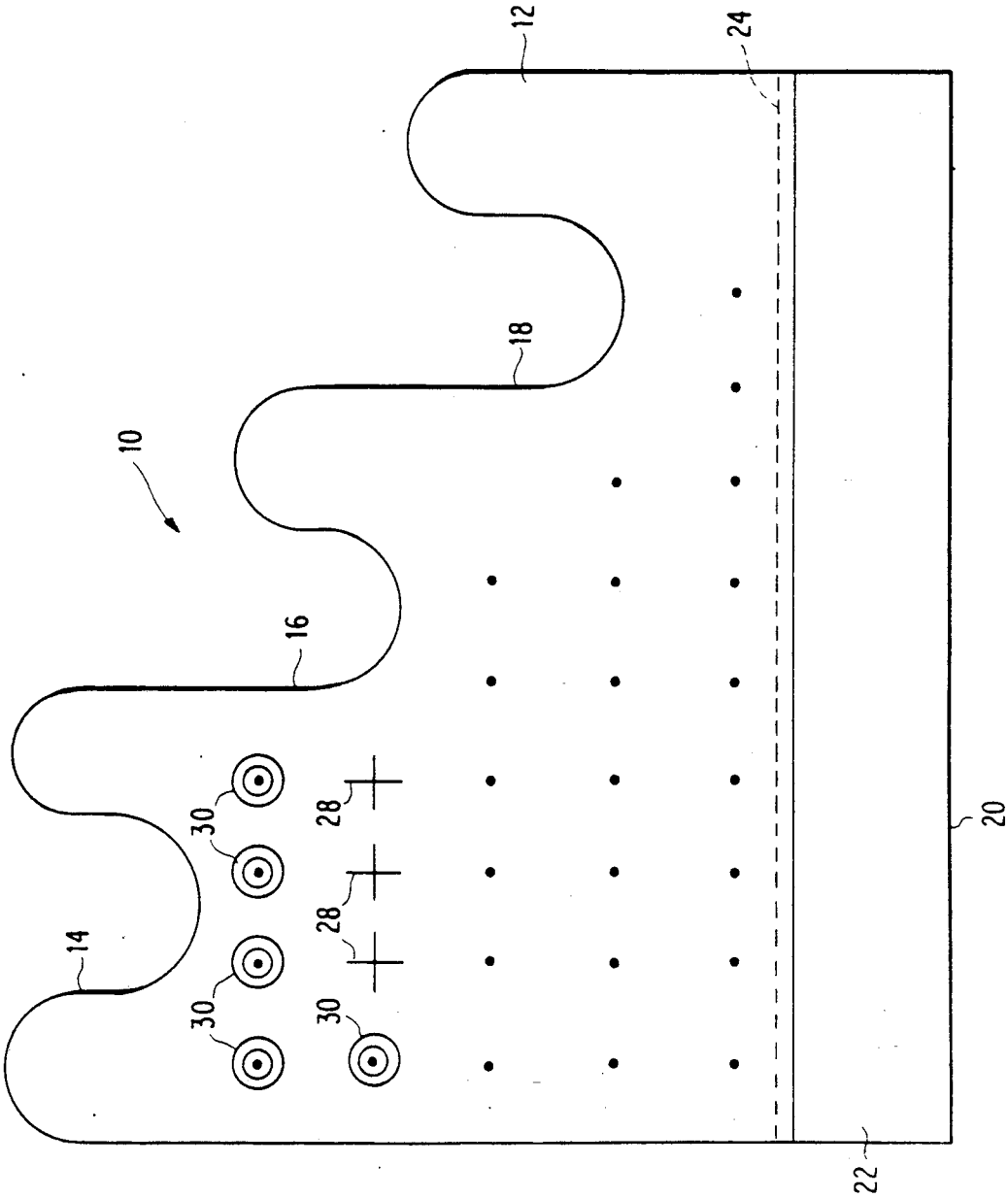
FIG. 1 is a front elevational view of the gun rest according to the present invention.

The specific material used for the construction of the gun rest has a level of resiliency or memory which enables the foam material to substantially return to its original position after being compressed. Since it is desirable to have the forearm of the rifle securely gripped in the selected grooves 14, 16 or 18, the grooves are dimensioned initially to securely grip rifles having relatively narrow forearms. Thus, other rifles having wider forearms can still be used by merely pressing them into the selected groove, causing the foam material to yield. Upon removal of the rifle, the foam material will substantially return to its original cut dimensions to once again accommodate rifles having narrower forearms and still be able to securely hold the narrower forearms. The same property of the foam material also makes it possible to securely grip ammunition of different sizes. If a hole were drilled into the material with the resultant removal of foam material, individual cartridges having a larger diameter would be securely gripped by the foam plastic material while smaller diameter cartridges would not be gripped and tend to fall out of the holes provided for the cartridges. By having a cross-shaped slit 28 formed in the foam plastic material as shown in FIG. 1, cartridges of any size can be pressed into the cross-shaped slit and be securely held therein. Upon removal of a cartridge, the foam material will substantially return to its original condition so that subsequent cartridges pressed into the gun rest will be securely held therein. The memory feature of the plastic material is also advantageous with respect to the cut 24 in the bottom of the gun rest for accommodating motor vehicle window glass. Glass of any thickness can be forced into the cut 24 and upon removal of the gun rest from the glass, the cut 24 will substantially close.

The foregoing dimensions have been given only by way of example and the dimensions of the gun rest can vary within the scope of the present invention. Likewise, other materials could also be used provided they have the same characteristic features of the foam plastic material described above.

The cross-cuts for the ammunition slits can be formed simultaneously with the die cutting of the grooves into the edge of the plastic sheet. Alternatively, the entire gun rest including the stabilizing strip could be formed in one piece by means of injection molding.

The gun rest according to the present invention has universal capability in that it can adapt to most guns for the reasons set forth above, function on standard rifle range shooter benches as well as on the ground and adapt to most motor vehicle window glasses. The gun rest design offers most of the desirable qualities expected from a gun rest. The gun rest is quiet, weatherproof, lightweight, durable, offers multi-fixed level shooting positions, snug forearm fit, holds ammunition and is economical.

While the invention has been particularly shown and described with reference to preferred embodiments thereof, it will be understood by those in the art that the foregoing and other changes in form and details may be made therein without departing from the spirit and scope of the invention.

What is claimed is:

1. A gun rest comprising a support body of foam plastic material having a front surface adapted to be substantially vertically disposed in a shooting position, a bottom surface adapted to rest on a suitable support, a slit extending into said body from said bottom surface and extending upwardly substantially parallel to said front face for fitting over a top edge of a motor vehicle window and a top surface having a plurality of parallel grooves formed therein substantially perpendicular to said front face with each groove having a bottom surface spaced from the bottom surface of said body at different respective distances.

2. A gun rest as set forth in claim 1, further comprising support means secured to said body to support said body in a desired vertical shooting position.

3. A gun rest comprising a support body of resilient foam plastic material having a front surface adapted to be substantially vertically disposed in a shooting position, a bottom surface adapted to rest on a suitable support and a top surface having a plurality of parallel grooves formed therein substantially perpendicular to said front face with each groove having a bottom surface spaced from the bottom surface of said body at different respective distances, wherein said plastic foam material is substantially rigid while capable of being resiliently compressed whereby a forearm of a rifle may be pressed into a respective groove and be securely held therein due to the resiliency of the plastic foam material.

4. A gun rest as set forth in claim 3, further comprising a plurality of blind slits extending into said front face of said body into which ammunition cartridges may be pressed and resiliently held.

* * * * *